US005395009A

United States Patent [19]

Kessler et al.

[11] Patent Number: 5,395,009

[45] Date of Patent: Mar. 7, 1995

[54] PLASTIC CONTAINER FOR FRUITS AND VEGETABLES

[75] Inventors: Volker Kessler, Kreuztal, Germany; Anton Bacher, Windisch, Switzerland

[73] Assignee: Gebr. Otto KG, Kreuztal, Germany

[21] Appl. No.: 180,920

[22] Filed: Jan. 12, 1994

[51] Int. Cl.[6] ..... B65D 1/44

[52] U.S. Cl. ..... 220/671; 220/670; 217/40; 217/42

[58] Field of Search ..... 206/521.1, 557; 220/669, 670, 671, 674, 675, DIG. 15; 229/120, 120.1; 217/40, 42

[56] References Cited

U.S. PATENT DOCUMENTS

| | | | |
|---|---|---|---|
| 505,164 | 9/1893 | Hughes | 220/669 |
| 930,216 | 8/1909 | McClung | 217/42 |
| 1,509,549 | 9/1924 | Freeland | 220/669 |
| 2,438,844 | 3/1948 | Dale | 220/671 |
| 3,005,572 | 10/1961 | Gustafson | 220/671 |
| 3,341,064 | 9/1967 | Ricci | 217/42 |
| 3,443,715 | 5/1969 | Edwards | 220/671 |
| 3,655,114 | 4/1972 | Turner | 217/42 |
| 3,987,829 | 10/1976 | Leone | 220/675 |
| 4,254,885 | 3/1981 | Fouss et al. | 220/675 |
| 4,597,503 | 7/1986 | Lates | 220/675 |

*Primary Examiner*—David T. Fidei
*Attorney, Agent, or Firm*—Herbert Dubno

[57] ABSTRACT

A plastic box has vertical walls and a bottom, the walls having openings in the form of slits which have their inner edges set outwardly at the bases of respective inwardly diverging troughs to minimize the contact of the contained fruits or vegetables with the inner edges of the openings.

13 Claims, 2 Drawing Sheets

PLASTIC CONTAINER FOR FRUITS AND VEGETABLES

FIELD OF THE INVENTION

Our present invention relates to a plastic (synthetic resin) container of a generally box shape, i.e. the shape of a rectangular parallelepiped with preferably a square outline and having an upwardly open configuration for receiving fruits and vegetables, the side walls of the container being formed with slit-like openings for ventilation.

BACKGROUND OF THE INVENTION

Box-like upwardly open containers for receiving fruits and vegetables are widely utilized both for distributing such products to the various markets, for storaging the fruits and vegetables, for collecting the fruits and vegetables preparatory to packaging or processing, etc.

In general, the walls of the box-like container are provided with openings to enable ventilation and allow the ripening process to proceed without excessive moisture accumulation, rotting or other detriment to the quality of the product.

However, it has frequently been found in dealing with sensitive products, i.e. products with easily damaged exteriors or skins, for example, applies, that the emplacement of the fruit against the inner sides of the slit or perforated container walls can cause the inner edges of the wall openings to so press into the surfaces of the fruit that the skin is damaged, that the fruit is marred to the point of discoloration and that the storage time or shelf life for the product can be sharply reduced.

OBJECTS OF THE INVENTION

It is, therefore, the principal object of the present invention to provide a container of plastic (synthetic resin) of the type described whose openings in the side walls and bottom cannot damage the fruit or vegetables introduced into the container.

It is another object of the invention to provide a plastic container with a box-like upwardly open configuration having slit-like openings at least in the side walls thereof, which is structurally simpler than earlier containers for the purposes described, is of a more stable configuration and provides a maximum storage volume for the products to be stored therein.

Yet another object of this invention is to provide an improved container for the storage and transport of sensitive skin fruit and vegetables which eliminates the problems of earlier containers, especially the drawbacks which have been described above.

SUMMARY OF THE INVENTION

These objects and others which will become apparent hereinafter are attained, in accordance with the invention, by providing the inner surfaces of the side walls in the regions of the openings so that they are set outwardly of the interior of the container such that the inner edges of the openings lie closer to the exterior of the container, i.e. to the container outer sides, than regions of the inner surface which are more removed from such openings. In other words the innermost edges defining the slit-like openings in the side walls are set outwardly from the surfaces in the interior of the container against which the product contained therein can bear so that there is little if any chance that the fruit or vegetable product can be pressed against those edges. Rather the inwardly lying surfaces of the walls are engaged by the product within the container to prevent the product from pressing against the innermost edges delimiting those openings.

With this configuration of the openings and the regions around the openings, we can ensure that the edges of the openings will not press into the outer surfaces of the fruit. It has been found to be especially advantageous to form the inner surfaces in the regions surrounding the openings as troughs at the deepest portions of which the edges of the opening are located. The flanks of the troughs can diverge inwardly from the edges of the opening or, conversely, can converge outwardly toward the edges of the opening.

Preferably the gradient lines of these flanks are straight line gradients running at least between the starting and ending ends of the gradient.

It has been found to be highly advantageous, moreover, to round the edges of the openings.

The comparatively thin container wall of high stability can be obtained when the opening edge at the side turned away form the interior has a bead or rib as reinforcement. These raised outwardly projecting rims can move the edges of the openings further outwardly. In the outwardly set portions, the wall preferably has a constant thickness.

More specifically, a container for fruits and vegetables according to the invention can comprise an upwardly open receptacle composed of a synthetic resin and having a bottom and side walls in a generally rectangular parallelepipedal configuration, the side walls being formed with openings in wall portions set outwardly with respect to an interior of the receptacle so that the openings are defined by edges located closer to an outer side of the receptacle than to the interior thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
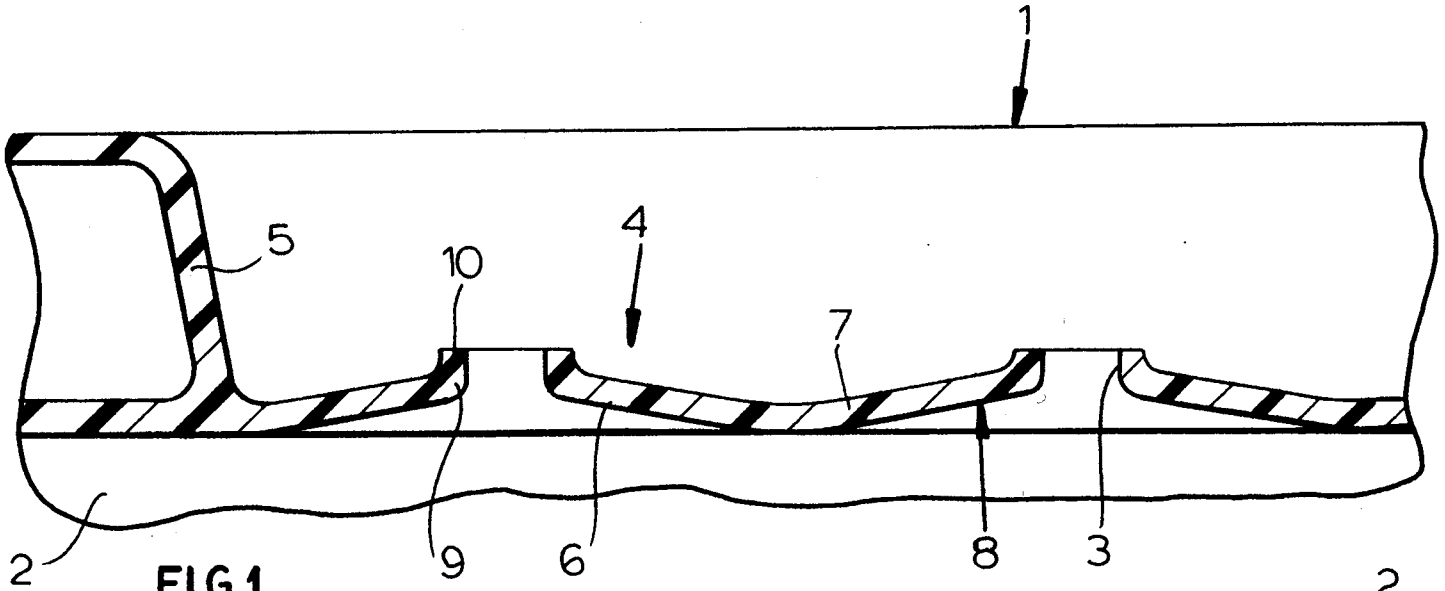
FIG. 1 is a horizontal cross section through a region of a vertical container wall according to the invention.

The plastic container of the invention can have a square outline and the form of an upwardly open rectangular parallelepiped with vertical walls 1 formed in one piece with a bottom 2. In the walls and, advantageously, in the bottom, slit-like openings 3 are formed which are parallel to one another. The vertical walls 1 have wall regions 4 which are provided with the openings 3 and at uniform spacings are interrupted by stiffening beams or hollow posts 5.

In the region of each opening 3, the inner surface 6 of the side wall 7 is set outwardly so that the inner edge of the respective opening lies closer to the outer side of the container than regions more removed from the inner edge.

Figure 2:
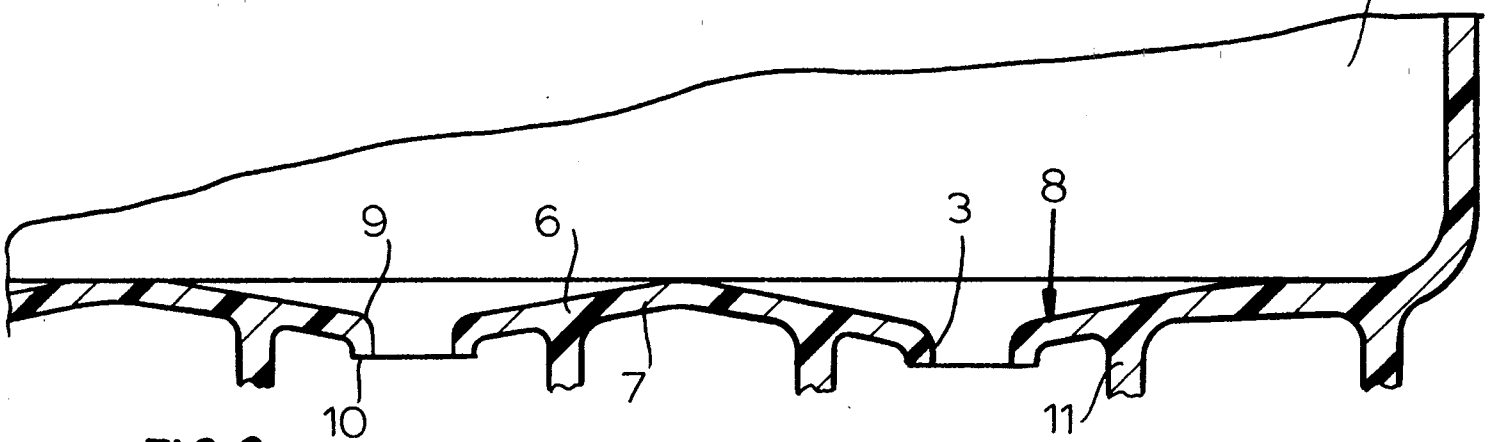
FIG. 2 is a horizontal section through the container wall in the region of the container bottom adjacent a corner of the container.
Figure 3:
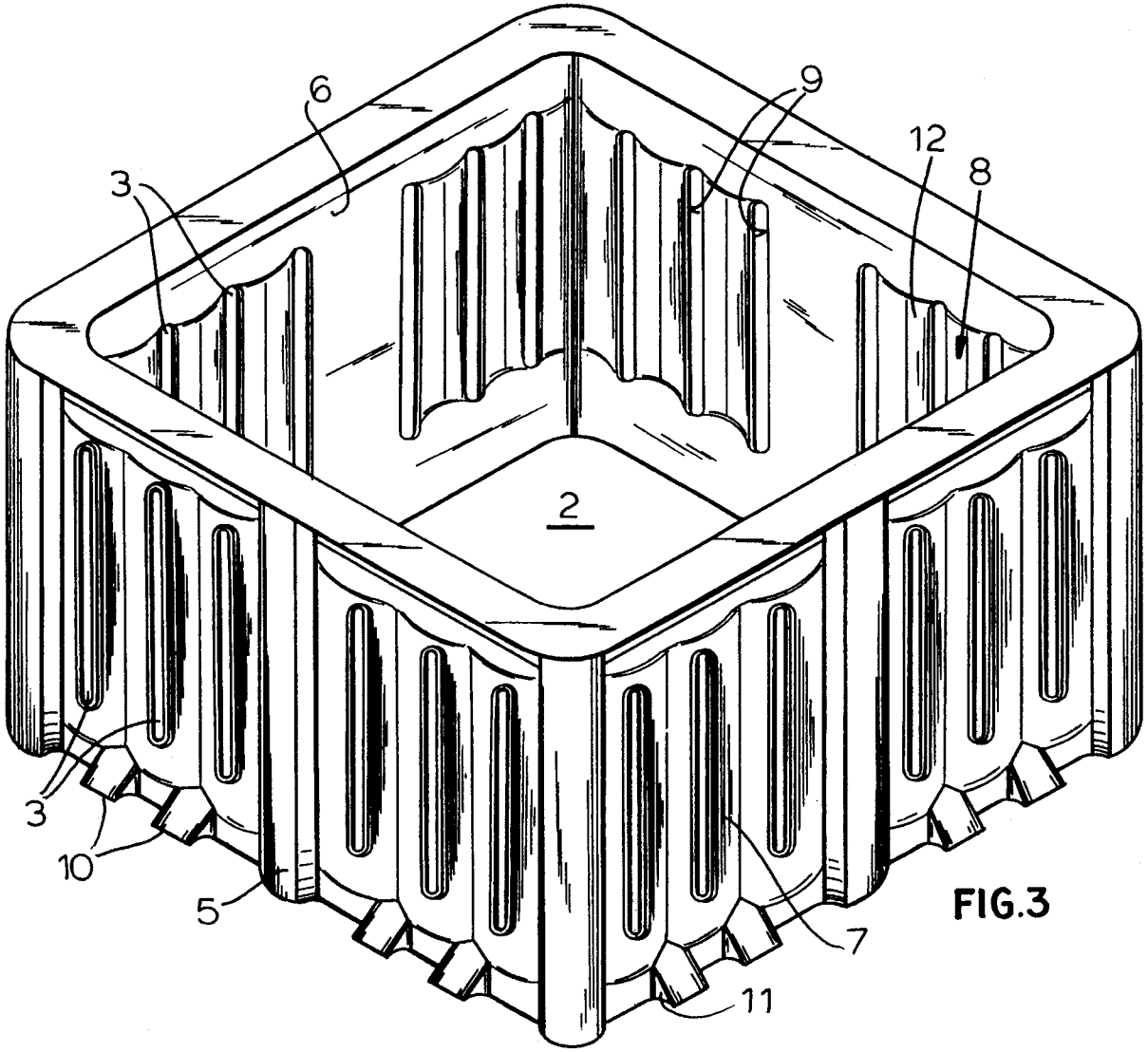
FIG. 3 is a perspective view showing a container embodying the side wall configuration of FIG. 1.

As a consequence, the inner surfaces 6 around each opening 3 form a respective trough 8 whose deepest part is the opening edge 9. As a consequence, when fruit or the like is placed in the container, the surface of the fruit presses against the flanks 12 of the respective trough inwardly from the opening edge so that any contact of the product with the edges 9 is greatly limited. Furthermore, the edges 9 are rounded as can be seen from FIGS. 1 and 2, thereby further limiting any damage to the fruit. Sharp edges which can press into the fruit are eliminated.

The opening edges 9 are formed on the side turned away from the interior of the container on the raised rims, beads or ridges 10 for reinforcement so that the side walls 7 of uniform thickness can be comparatively thin, thereby saving material.

In the region of the bottom 2, between the openings 3 and the walls 7 and at the junctions of the walls 7 with the bottom 2, the walls 7 are formed at their undersides with ribs 11 which enhance the stability of the bottoms.

We claim:

1. A container for fruits and vegetables, comprising an upwardly open receptacle composed of a synthetic resin and having a bottom and side walls of substantially a constant wall thickness and in a generally rectangular parallelepipedal configuration, said side walls having innermost surfaces and outer surfaces spaced by said wall thickness from said innermost surfaces, said side walls being formed with openings in wall portions set outwardly with respect to said innermost surfaces so that said openings are defined by edges located closer to an outer side of the receptacle than to the innermost surfaces and are spaced from said innermost surfaces by a distance greater than said wall thickness, said wall portions forming inwardly open troughs having said openings at bottoms of the troughs, said troughs being defined by surfaces converging continuously to said openings.

2. The container defined in claim 1 wherein said surfaces have straight-line gradients except at ends of said gradients.

3. The container defined in claim 2 wherein said edges of said openings are rounded.

4. The container defined in claim 3 wherein said openings have raised outwardly projecting rims.

5. The container defined in claim 4 wherein said wall portions which are set outwardly have a constant thickness.

6. The container defined in claim 5 wherein said receptacle has a generally square outline.

7. The container defined in claim 6, wherein said walls are formed with reinforcing hollow posts.

8. The container defined in claim 7 wherein said walls are formed along exteriors thereof with ribs adjacent said bottom for reinforcing said receptacle.

9. The container defined in claim 1 wherein said edges of said openings are rounded.

10. The container defined in claim 1 wherein said openings have raised outwardly projecting rims.

11. The container defined in claim 1 wherein said receptacle has a generally square outline.

12. The container defined in claim 1 wherein said walls are formed with reinforcing hollow posts.

13. The container defined in claim 1 wherein said walls are formed along exteriors thereof with ribs adjacent said bottom for reinforcing said receptacle.

* * * * *